United States Patent [19]

Bosse

[11] 4,120,223

[45] Oct. 17, 1978

[54] APPARATUS FOR MAKING TAPES

[75] Inventor: Frank Bosse, Tecklenburg, Fed. Rep. of Germany

[73] Assignee: Windmoller & Holscher, Lengerich, Fed. Rep. of Germany

[21] Appl. No.: 841,725

[22] Filed: Oct. 13, 1977

[30] Foreign Application Priority Data

Nov. 15, 1976 [DE] Fed. Rep. of Germany ..... 2652011

[51] Int. Cl.[2] ..... B26D 1/10

[52] U.S. Cl. ..... 83/425.3; 83/433; 83/926 H

[58] Field of Search ..... 83/425, 425.2, 425.3, 83/425.4, 926 H, 433, 435

[56] References Cited

U.S. PATENT DOCUMENTS

| | | | |
|---|---|---|---|
| 1,731,902 | 10/1929 | Lodding | 83/435 |
| 3,468,203 | 9/1969 | Armelin et al. | 83/433 |
| 4,018,119 | 4/1977 | Lennox | 83/425 X |

*Primary Examiner*—Willie G. Abercrombie

*Attorney, Agent, or Firm*—Fleit & Jacobson

[57] ABSTRACT

In an apparatus comprising a set of juxtaposed spaced cutting blades for severing a continuously fed web of material into strips, means are provided for pivoting the blades to and fro during the severing operation so as to avoid localized overheating and wear of the cutting edges.

8 Claims, 2 Drawing Figures

APPARATUS FOR MAKING TAPES

The invention relates to an apparatus for making tapes by longitudinally severing continuously fed films, comprising a guide rod and a set of juxtaposed cutting knives.

In an apparatus of this kind known from DT-AS 1 927 899 and DT-OS 2 401 871, the web that is to be severed into strips runs over a stationary guide rod which is equipped with the cutting knives. On continuous operation, the latter undergo intensive wear so that the installation has to be brought to a standstill at relatively short time intervals to change the tools.

It is the problem of the present invention to provide an apparatus of the aforementioned kind for making tapes for longitudinally severing continuously fed films, which apparatus gives a long life for the cutting knives.

This problem is solved according to the invention in that the cutting knives are pivotably mounted in the guide rod and provided with a pivoting drive which moves the cutting regions to and fro over the cutting edges during cutting. In the apparatus according to the invention, the knives which are constantly pivoted during operation will continuously cut with different portions of their cutting edges, thereby avoiding a continuous stress on only a single portion of the cutting knives and their overheating, which bring about increased wear. By reason of the fact that different portions of the cutting edges are stressed continuously, the rapid blunting and the hitherto considerable wear of the cutting edges are avoided and their life is considerably prolonged. The apparatus of the invention therefore also permits better utilisation of the machines that do further processing on the tapes because these machines no longer have to be stopped so frequently as was necessary with known cutting machines during the times for replacing the blunted knives.

Desirably, the cutting knives, which are combined to form a packet, are secured on a bar connected to a shaft which can be swung to and fro about its axis by a lever lying against an eccentric.

The guide rod can be hollow, have a longitudinal groove and be closed by end plates.

In a particularly advantageous embodiment of the invention, the eccentric is mounted in a plate which is pivotable about the shaft and can be clamped to the guide rod. By turning the plate, the cutting knives can be retracted into the guide rod and projected therefrom. The cutting knives can therefore be easily moved to and from their operative position so that there is no problem in starting the cuts in the film during starting of the apparatus and there is less danger of injury to the operating personnel. To enable the cutting knives to be retracted into the interior of the hollow guide rod, it is merely necessary for the plate carrying the eccentric to be rotatable relatively to the guide rod. Accordingly, the guide rod or the plate can be fixed with respect to the frame, both being clamped to each other in the desired operating position.

An example of the invention will now be described in more detail with reference to the drawing, in which.

Figure 1:
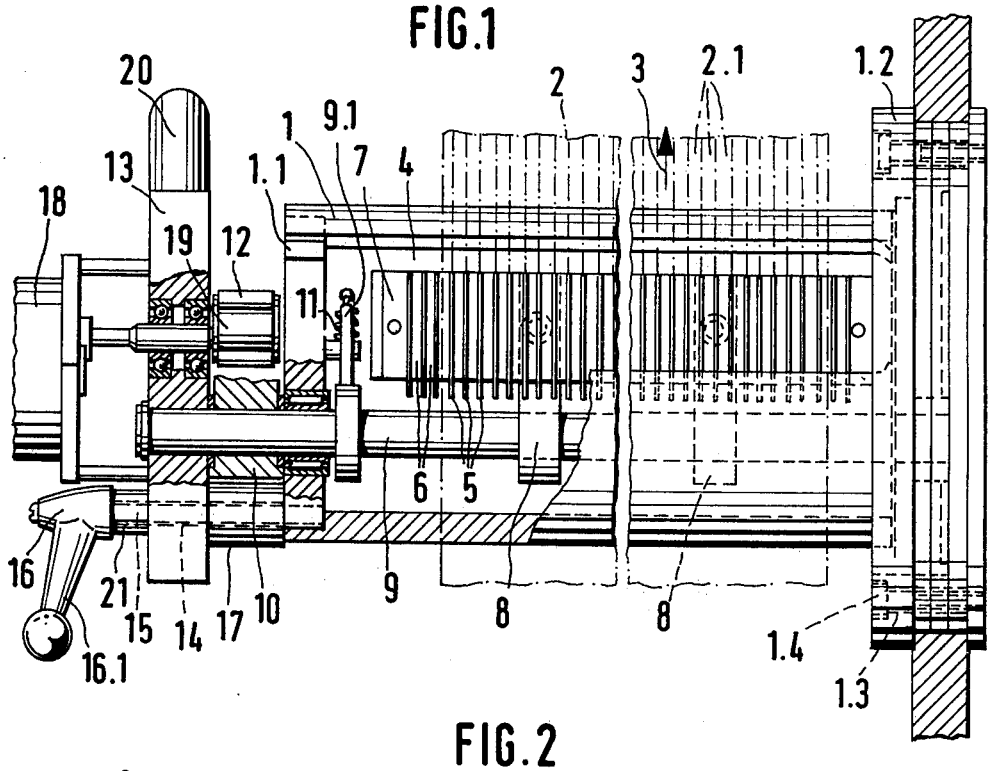
FIG. 1 is a side elevation of the cutting apparatus.

A web of film 2 which is cut into tapes 2.1 in the cutting apparatus is moved in the direction of the arrow 3 over a guide rod 1 which is fixed with respect to the frame, hollow and comprises end plates 1.1 and 1.2 as well as a longitudinal groove 4. The end plate 1.2 comprises a number of curved slots 1.3 which are concentric with the axis of the guide rod 1 and in which there are disposed screws 1.4 that connect the guide rod 1 to the frame of the machine. In the guide rod 1 there is a set of cutting knives 5 which are spaced from each other by spacers 6 by a distance corresponding to the subsequent width of the tapes. The cutting knives 5 are secured on a bar 7 which is longer than the web 2 is wide. The bar 7 is connected by transverse bars 8 to a shaft 9 which is loosely rotatable in the end plates 1.1 and 1.2. A lever 10 secured to the shaft 9 makes constant contact with a cam roller 12 under the force of a tension spring 11. One end of the tension spring 11 is secured to the guide rod 1 or the end plate 1.1 and the other end is connected to a pin 9.1 secured to the shaft 9.

Loosely rotatably mounted on the shaft 9 there is a plate 13 which has a handle 20 and an arcuate groove 14 of which the centre of curvature coincides with the axis of the shaft 9. A screw-threaded bolt 15 on which there is a clamping nut 16 passes into the groove 14 and is secured in the guide rod 1 or its end plate 1.1. A spacer 17 provided with a hole and placed over the screw-threaded bolt 15 is disposed between the plate 13 and the end plate 1.1. A further spacer 21 is pushed onto the screw-threaded bolt between the plate 13 and the clamping nut 16. On rotation of the clamping nut 16, to which a handle 16.1 is secured for this purpose, the plate 13 is fixed relatively to the guide rod 1 or loosened therefrom.

Screwed tightly to the plate 13 there is an electric gear motor 18 on the output shaft of which there is secured an eccentric 19 on which the cam roller 12 is loosely rotatable. By means of the tension spring 11, the lever 10 always lies against the cam roller 12 and, when the gear motor 18 is in operation, is pivoted to and fro as a result of the eccentric 19 and by an amount determined by its eccentricity. During one rotation of the output shaft of the gear motor 18, the knives 5 therefore project from the longitudinal groove. The web of film 2 stretched over the groove 4 thus touches the cutting edges of the knives 5 once, e.g. at the centre, and during a further half rotation of the output shaft of the gear motor 18 touches them nearer the edge of the knives. By reason of the continuous traversing motion, localised heating and premature wear of a single portion of the knives 5 are avoided.

Figure 2:
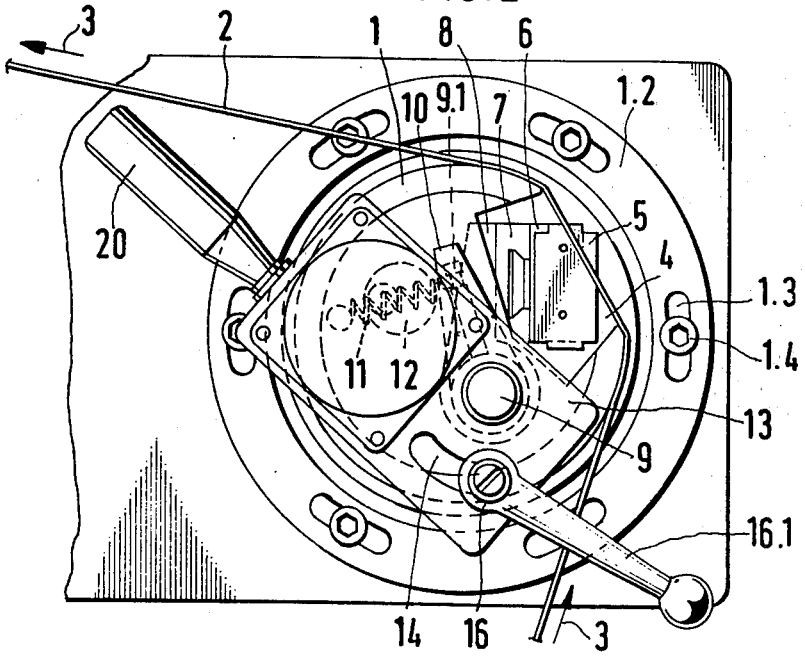
FIG. 2 is a section on the line II—II in FIG. 1.

For starting purposes, the plate 13 is loosened by turning the clamping nut 16. Under the action of the tension spring 11, which effects a further pivoting motion of the shaft 9 after turning the plate 13 to the left, the knives 5 are retracted into the groove 4 or the cavity of the guide rod 1 so that the web of film 2 can be pulled without danger over the guide rod 1. By pivoting the plate 13 inwardly to the FIG. 2 operative position, the web of film 2 is severed by the knives 5. After tightening the nut 16, the motor 18 is switched on and the constant traversing motion of the knives 5 commences.

I claim:

1. An apparatus for making tapes by longitudinally severing continuously fed film comprising:

a frame;

a guide rod mounted in said frame;

a set of juxtaposed cutting knives pivotably mounted on said guide rod, said knives having cutting edges with cutting regions defined on the cutting edges for contacting and severing film; and pivoting drive means for driving said set of juxtaposed cutting knives in such manner that the cutting regions move to and fro over the cutting edges while severing continuously fed film.

2. An apparatus according to claim 1 further comprising:

a bar for mounting the set of juxtaposed cutting knives;

a shaft operatively associated with the guide rod and connected to said bar, the shaft being movable to and fro about its axis thereby moving said cutting regions to and fro over the cutting edges of said knives;

lever means connected to said shaft for controlling movement of said shaft; and eccentric means within said pivoting drive means for controlling movement of said lever means.

3. An apparatus according to claim 2 wherein said guide rod is hollow and includes first and second end plates interconnected by a rod member, the rod member including a longitudinal groove.

4. An apparatus according to claim 3 wherein said guide rod includes means for loosely rotatably mounting said shaft.

5. An apparatus according to claim 3 wherein said end plates include means for loosely rotatably mounting said shaft.

6. An apparatus according to claim 2 wherein said pivoting drive means includes spring means for holding said lever in contact with said eccentric means.

7. An apparatus according to claim 2 wherein said pivoting drive means includes an electric gear motor for driving said eccentric means.

8. An apparatus according to claim 2 further comprising a plate pivotable about said shaft, said plate being adapted to be clamped to said guide rod and said eccentric means being mounted on said plate.

* * * * *